US009837193B2

(12) United States Patent
Kuniyoshi

(10) Patent No.: US 9,837,193 B2
(45) Date of Patent: Dec. 5, 2017

(54) R-T-B SINTERED MAGNET

(75) Inventor: Futoshi Kuniyoshi, Osaka (JP)

(73) Assignee: HITACHI METALS, LTD., Tokyo (JP)

( * ) Notice: Subject to any disclaimer, the term of this patent is extended or adjusted under 35 U.S.C. 154(b) by 636 days.

(21) Appl. No.: 13/980,133

(22) PCT Filed: Jan. 19, 2012

(86) PCT No.: PCT/JP2012/051038

§ 371 (c)(1),
(2), (4) Date: Jul. 17, 2013

(87) PCT Pub. No.: WO2012/099188

PCT Pub. Date: Jul. 26, 2012

(65) Prior Publication Data

US 2013/0293328 A1 Nov. 7, 2013

(30) Foreign Application Priority Data

Jan. 19, 2011 (JP) ..... 2011-008434

(51) Int. Cl.
*H01F 1/053* (2006.01)
*B22F 3/24* (2006.01)
(Continued)

(52) U.S. Cl.
CPC ..... *H01F 1/0536* (2013.01); *B22F 3/24* (2013.01); *C22C 33/0278* (2013.01);
(Continued)

(58) Field of Classification Search
CPC ..... H01F 1/0577; H01F 41/0293
See application file for complete search history.

(56) References Cited

U.S. PATENT DOCUMENTS

2006/0213584 A1* 9/2006 Nakamura ..... C22C 38/005 148/302
2008/0286595 A1* 11/2008 Yoshimura ..... B22F 7/062 428/548

(Continued)

FOREIGN PATENT DOCUMENTS

CN 101375352 A 2/2009
JP 2004-296973 A 10/2004
WO 2009/107397 A1 9/2009

OTHER PUBLICATIONS

English translation of Official Communication issued in corresponding International Application PCT/JP2012/051038, dated Aug. 1, 2013.

(Continued)

*Primary Examiner* — Xiaowei Su
(74) *Attorney, Agent, or Firm* — Keating & Bennett, LLP

(57) ABSTRACT

This sintered R-T-B based rare-earth magnet includes: $R_2Fe_{14}B$ type compound crystal grains, including a light rare-earth element RL (which includes at least one of Nd and Pr) as a major rare-earth element R, as main phases; and a heavy rare-earth element RH (which includes at least one of Dy and Tb). Before its surface region is removed, the sintered R-T-B based rare-earth magnet has no layer including the rare-earth element R at a high concentration in that surface region. The sintered R-T-B based rare-earth magnet has a portion in which coercivity decreases gradually from its surface region toward its core portion. The difference in the amount of TRE between a portion of the sintered R-T-B based rare-earth magnet that reaches a depth of 500 μm as measured from its surface region toward its core portion and the core portion of the sintered R-T-B based rare-earth magnet is 0.1 through 1.0.

1 Claim, 1 Drawing Sheet

(51) Int. Cl.

| | |
|---|---|
| ***C22C 33/02*** | (2006.01) |
| ***C22C 38/00*** | (2006.01) |
| ***H01F 41/02*** | (2006.01) |
| *H01F 1/057* | (2006.01) |

(52) U.S. Cl.
CPC ..... *C22C 38/00* (2013.01); *C22C 38/005* (2013.01); *H01F 41/0293* (2013.01); *H01F 1/0577* (2013.01)

(56) References Cited

U.S. PATENT DOCUMENTS

| | | | |
|---|---|---|---|
| 2009/0297699 | A1 | 12/2009 | Baba et al. |
| 2010/0231338 | A1 | 9/2010 | Morimoto et al. |
| 2012/0025651 | A1 | 2/2012 | Komuro et al. |
| 2012/0112863 | A1 | 5/2012 | Kuniyoshi |
| 2012/0176211 | A1 | 7/2012 | Sagawa |
| 2013/0087248 | A1 | 4/2013 | Kuniyoshi |

OTHER PUBLICATIONS

Official Communication issued in International Patent Application No. PCT/JP2012/051038, dated Apr. 24, 2012.

* cited by examiner

R-T-B SINTERED MAGNET

TECHNICAL FIELD

The present invention relates to a sintered R-T-B based magnet (where R is a rare-earth element and T is a transition metal element including Fe) including $R_2T_{14}B$ type compound crystal grains as its main phases.

BACKGROUND ART

A sintered R-T-B based magnet, including $R_2T_{14}B$ type compound crystal grains as main phases, is known as a permanent magnet with the highest performance, and has been used in various types of motors such as a voice coil motor (VCM) for a hard disk drive and a motor for a hybrid car and in numerous types of consumer electronic appliances.

As a sintered R-T-B based magnet loses its coercivity at high temperatures, such a magnet will cause an irreversible flux loss. For that reason, when used in a motor, for example, the magnet should maintain coercivity that is high enough even at elevated temperatures to minimize the irreversible flux loss.

It is known that if R in the $R_2T_{14}B$ type compound crystal grains is replaced with a heavy rare-earth element RH (which may be Dy or Tb), the coercivity of a sintered R-T-B based magnet will increase. It is effective to add a lot of such a heavy rare-earth element RH to the sintered R-T-B based magnet to achieve high coercivity at a high temperature. However, if the light rare-earth element RL (which may be Nd or Pr) is replaced with the heavy rare-earth element RH as R in a sintered R-T-B based magnet, the coercivity certainly increases but the remanence decreases instead. Furthermore, as the heavy rare-earth element RH is one of rare natural resources, its use should be cut down.

For these reasons, various methods for increasing the coercivity of a sintered magnet effectively with the addition of as small an amount of the heavy rare-earth element RH as possible have recently been researched and developed in order to avoid decreasing the remanence. The applicant of the present application already disclosed, in Patent Document No. 1, a method for diffusing a heavy rare-earth element RH inside of a sintered R-T-B based magnet body while supplying the heavy rare-earth element RH onto the surface of the sintered R-T-B based magnet body (which will be referred to herein as an "evaporation diffusion process"). According to Patent Document No. 1, inside of a processing chamber made of a refractory metallic material, the sintered R-T-B based magnet body and an RH bulk body are arranged so as to face each other with a predetermined gap left between them. The processing chamber includes a member for holding multiple sintered magnet bodies and a member for holding the RH bulk body. A method that uses such an apparatus requires a series of process steps of arranging the RH bulk body in the processing chamber, introducing a holding member, putting the sintered magnet bodies on a net, mounting the holding member on the sintered magnet bodies, putting the upper RH bulk body on the net, and sealing the processing chamber hermetically and carrying out an evaporation diffusion.

Patent Document No. 2 discloses that in order to improve the magnetic properties of an R-T-B based intermetallic compound magnetic material, a powder of Yb metal with a low boiling point and a sintered R-T-B based magnet body are sealed and heated in a thermally resistant hermetic container, thereby depositing uniformly a coating of Yb metal on the surface of the sintered R-T-B based magnet body and diffusing a rare-earth element inside of the sintered R-T-B based magnet body from that coating (see, in particular, Example #5 of Patent Document No. 2).

Patent Document No. 3 discloses conducting a heat treatment process with a ferrous compound of a heavy rare-earth compound including Dy or Tb as a heavy rare-earth element attached to a sintered R-T-B based magnet body.

CITATION LIST

Patent Literature

Patent Document No. 1: PCT International Application Publication No. 2007/102391

Patent Document No. 2: Japanese Laid-Open Patent Publication No. 2004-296973

Patent Document No. 3: Japanese Laid-Open Patent Publication No. 2009-289994

SUMMARY OF INVENTION

Technical Problem

According to the method of Patent Document No. 1, the heavy rare-earth element RH can be supplied onto the sintered magnet body at a lower temperature of 700° C. to 1000° C. than when the surface of the sintered R-T-B based magnet body is coated with such an element by sputtering or evaporation process, and therefore, the heavy rare-earth element RH is not supplied excessively onto the sintered R-T-B based magnet body. As a result, a sintered R-T-B based magnet with increased coercivity can be obtained almost without decreasing the remanence. However, the RH bulk body that supplies the heavy rare-earth element RH is used. That is why if the RH bulk body were heated in contact with the sintered R-T-B based magnet body, then the RH bulk body could react with the sintered R-T-B based magnet body to have its property affected. In addition, since the sintered R-T-B based magnet body and the RH bulk body including the heavy rare-earth element RH need to be arranged in the processing chamber with a gap left between them to avoid causing a reaction between the RH bulk body and the sintered R-T-B based magnet body, it takes a lot of trouble to get the arrangement process done.

On the other hand, according to the method of Patent Document No. 2, if the rare-earth metal in question has as high a saturated vapor pressure as Yb, Eu or Sm, deposition of its coating onto the sintered magnet body and diffusion of that element from the coating can be done by carrying out a heat treatment within the same temperature range (e.g., 800° C. to 850° C.). However, according to Patent Document No. 2, to coat the surface of a sintered R-T-B based magnet body with a deposited film of a rare-earth element with a low vapor pressure such as Dy or Tb, the rare-earth metal in the form of powder should be heated selectively to high temperatures by performing an induction heating process using an RF heating coil. And to heat Dy or Tb to a higher temperature than the sintered R-T-B based magnet body, Dy or Tb and the sintered R-T-B based magnet body should be spaced apart from each other. That is why according to the basic technical idea and method of Patent Document No. 2, unless Dy or Tb and the sintered R-T-B based magnet body were spaced apart from each other, the RH diffusion source would react with the sintered R-T-B based magnet body to have its property altered as in the method disclosed in Patent Document No. 1. In addition, even if Dy or Tb and the sintered R-T-B based magnet body are spaced apart from each other, a thick coating of Dy or Tb is deposited (to several ten μm or more, for example) on the surface of the sintered R-T-B based magnet body when the Dy or Tb powder in the powder form is selectively heated to a high temperature. Then, Dy or Tb will diffuse and enter the inside of the main phase crystal grains in the vicinity of the surface of the sintered R-T-B based magnet body, thus causing a decrease in remanence.

According to the method of Patent Document No. 3, as the heat treatment process is carried out with a ferrous alloy powder of Dy or Tb attached to the sintered R-T-B based magnet body, Dy or Tb diffuses from a fixed point of attachment into the sintered R-T-B based magnet body. Since the ferrous alloy of Dy or Tb used is a fine powder with a size of 50 μm to 100 nm, such a fine powder is hard to remove completely and likely to remain in the heat treatment furnace after the heat treatment process. Such a ferrous alloy of Dy or Tb that remains in the furnace after the heat treatment process easily reacts with the sintered R-T-B based magnet body to treat next and is likely to turn into a contamination. On top of that, since the additional process step of dissolving the ferrous alloy powder of Dy or Tb in a solvent or turning the powder into slurry and applying it needs to be performed, it takes a lot of trouble to make a sintered R-T-B based magnet, which is a problem.

Furthermore, if the heavy rare-earth element such as Dy is diffused inside of a magnet from its surface, a light rare-earth element such as Nd, which has been present in the magnet originally, could also diffuse toward the surface of the magnet to form a rare-earth-rich layer on the surface of the magnet in some cases. Such a layer would be easy to get oxidized and deteriorate the weather resistance of the magnet.

An object of the present invention is to provide a sintered R-T-B based magnet with good weather resistance in which a heavy rare-earth element RH such as Dy or Tb has been diffused inside from the surface of the sintered R-T-B based magnet body without causing a decrease in remanence.

Solution to Problem

A sintered R-T-B based rare-earth magnet according to the present invention includes, as main phases, $R_2Fe_{14}B$ type compound crystal grains including a light rare-earth element RL (which includes at least one of Nd and Pr) as a major rare-earth element R, and also includes a heavy rare-earth element RH (which includes at least one of Dy and Tb). Before its surface region is removed, the sintered R-T-B based rare-earth magnet has no layer including the rare-earth element R at a high concentration in that surface region. The sintered R-T-B based rare-earth magnet has a portion in which coercivity decreases gradually from its surface region toward its core portion. Before its surface region is removed, the difference in the amount of TRE between a portion of the sintered R-T-B based rare-earth magnet that reaches a depth of 500 μm as measured from its surface region toward its core portion and the core portion of the sintered R-T-B based rare-earth magnet is 0.1 through 1.0.

In one preferred embodiment, the amount of TRE of the sintered R-T-B based rare-earth magnet is 28.0 mass % to 32.0 mass %.

Advantageous Effects of Invention

According to the present invention, before its surface region is removed, the sintered R-T-B based rare-earth magnet has no layer including the rare-earth element R at a high concentration in that surface region. And the difference in the amount of TRE between a portion of the sintered R-T-B based rare-earth magnet that reaches a depth of 500 μm as measured from its surface region toward its core portion and that core portion is 0.1 through 1.0. Consequently, the decline in weather resistance can be minimized.

In addition, the sintered R-T-B based rare-earth magnet of the present invention has no layer including the rare-earth element R at a high concentration in that surface region, and has a portion in which coercivity decreases gradually from its surface region toward its core portion. Thus, a relatively small amount of heavy rare-earth element RH can be used effectively and the coercivity can be increased effectively without causing a decrease in remanence.

DESCRIPTION OF EMBODIMENTS

Figure 1:
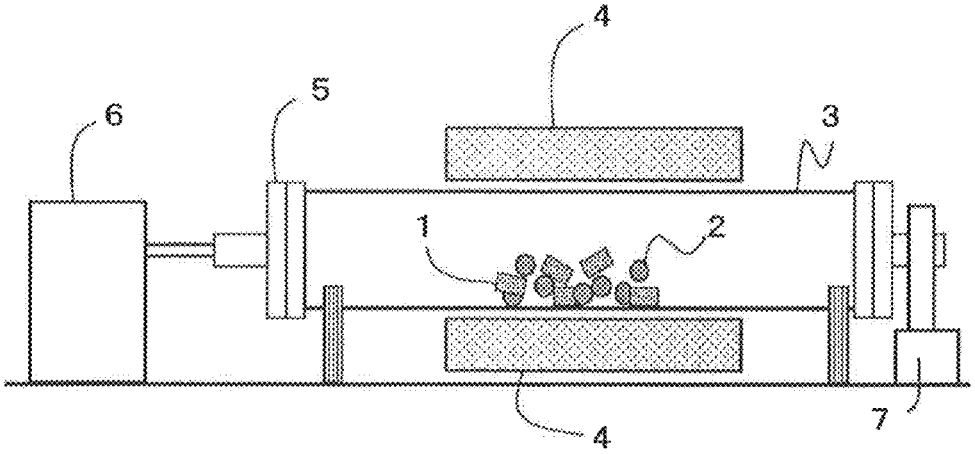
FIG. 1 A cross-sectional view schematically illustrating a configuration for a diffusion system for use in a preferred embodiment of the present invention.

A sintered R-T-B based rare-earth magnet according to the present invention includes: $R_2Fe_{14}B$ type compound crystal grains, including a light rare-earth element RL (which includes at least one of Nd and Pr) as a major rare-earth element R, as main phases; and a heavy rare-earth element RH (which includes at least one of Dy and Tb). Before its surface region is removed, the sintered R-T-B based rare-earth magnet has no layer including the rare-earth element R at a high concentration in that surface region. The sintered R-T-B based rare-earth magnet has a portion in which coercivity decreases gradually from its surface region toward its core portion. The difference in the amount of TRE between a portion of the sintered R-T-B based rare-earth magnet that reaches a depth of 500 μm as measured from its surface region toward its core portion and the core portion of the sintered R-T-B based rare-earth magnet is 0.1 through 1.0. In this description, the "amount of TRE" refers herein to the total mass percentage of rare-earth elements (including the light rare-earth element RL and the heavy rare-earth element RH) per unit volume and its unit is mass %.

Also, the "layer including the rare-earth element R at a high concentration in the surface region of sintered R-T-B based rare-earth magnet" refers herein to an alloy layer including a heavy rare-earth element RH that has been introduced from outside of the magnet to cause RH diffusion and a light rare-earth element RL that has emerged from inside of the sintered R-T-B based rare-earth magnet as a result of the RH diffusion. Unlike the technique disclosed in Patent Document No. 1, almost no such layer including rare-earth elements at a high concentration is produced according to the present invention in the surface region of the sintered R-T-B based rare-earth magnet.

Since the sintered R-T-B based magnet of the present invention is subjected to a diffusion process at a relatively low temperature as will be described later, a relatively small amount of the heavy rare-earth element RH vaporizes from the RH diffusion source and gets introduced into the surface region of the sintered R-T-B based magnet. According to the present invention, by repeatedly bringing RH diffusion sources and sintered R-T-B based magnets into and out of contact with each other in a heat treatment furnace at a relatively low temperature, the RH diffusion sources and the sintered R-T-B based magnets can directly contact with each other so as to avoid adhesion and the heavy rare-earth element RH can be made to diffuse from the RH diffusion sources into the sintered R-T-B based magnets. As a result, the heavy rare-earth element RH can be made to diffuse inside the magnets without forming a thin film of the heavy rare-earth element on the surface of the sintered R-T-B based rare-earth magnets. According to the present invention, since a relatively small amount of heavy rare-earth element RH can be made to diffuse inside the sintered R-T-B based magnets efficiently, only a small amount of light rare-earth element will emerge to form almost no thin film of rare-earth elements on the surface of the sintered R-T-B based rare-earth magnets unlike the technique disclosed in Patent Document No. 1.

According to the present invention, before the surface region of the sintered R-T-B based rare-earth magnet is removed, the difference in the amount of TRE between a portion of the sintered R-T-B based rare-earth magnet that reaches a depth of 500 μm as measured from its surface region toward its core portion and the core portion of the sintered R-T-B based rare-earth magnet is 0.1 through 1.0. As a result, the degree of grain boundary corrosion of the sintered R-T-B based magnet becomes the same as that of a sintered R-T-B based magnet that is not subjected to the RH diffusion process. The degree of grain boundary corrosion is suitably within the range of 0.5 mass % to 0.9 mass % and more suitably falls within the range of 0.6 mass % through 0.8 mass %.

In this description, the amount of TRE included in a portion of the sintered R-T-B based rare-earth magnet that reaches a depth of 500 μm as measured from its surface region toward its core portion refers herein to the amount of TRE included in that surface-to-core 500 μm portion before the surface region to which the heavy rare-earth element RH has been introduced is removed from the sintered R-T-B based rare-earth magnet.

The core portion refers herein to the core portion of the sintered R-T-B based magnet that has been subjected to the diffusion process. More specifically, the core portion is a portion of the sintered R-T-B based rare-earth magnet to be cut out of its core so as to have an analogous shape to that of the sintered R-T-B based rare-earth magnet itself.

Before the surface region of the sintered R-T-B based rare-earth magnet to which the heavy rare-earth element RH had been introduced was removed, the amount of TRE included in a portion of the sintered R-T-B based rare-earth magnet that reached a depth of 500 μm as measured from its surface region toward its core portion was measured by ICP by cutting out that surface-to-core 500 μm portion of the sintered R-T-B based rare-earth magnet to which the heavy rare-earth element RH had been introduced.

Since the sintered R-T-B based rare-earth magnet has an amount of TRE of 28.5 mass % through 32.0 mass %, the effect of increasing the corrosion resistance according to the present invention can be achieved significantly.

If the amount of TRE were more than 32.0 mass %, then the R mole fraction would be too much to achieve the effect of increasing the corrosion resistance according to the present invention significantly because the sintered R-T-B based magnet body will easily cause grain boundary corrosion in the first place. The R mole fraction is suitably within the range of 30.8 mass % to 29.5 mass %, and more suitably falls within the range of 30.5 mass % to 29.7 mass %.

However, if the amount of TRE were less than 28.5 mass %, then $R_2Fe_{14}B$ type compound crystal grains would not be produced sufficiently and the resultant magnet would not work fine as a magnet.

The sintered R-T-B based magnet of the present invention is suitably produced in the following manner.

First of all, a sintered R-T-B based magnet body and an RH diffusion source are loaded into a processing chamber (or a process vessel) so as to be movable relative to each other and brought close to, or in contact with, each other, and then are heated to, and maintained at, a temperature (processing temperature) of 500° C. through 850 AD, more suitably a processing temperature of 700° C. through 850° C. The RH diffusion source is an alloy including a heavy rare-earth element RH (which is at least one of Dy and Tb) or a heavy rare-earth element RH (which is at least one of Dy and Tb). In this case, by rotating, rocking or shaking the processing chamber, the sintered R-T-B based magnet body and the RH diffusion source are moved either continuously or discontinuously in the processing chamber, thereby changing the point of contact between the sintered R-T-B based magnet body and the RH diffusion source. At the same time, the heavy rare-earth element RH can not only be vaporized (sublimed) and supplied onto the sintered R-T-B based magnet body but also be diffused inside the sintered magnet body simultaneously while the sintered R-T-B based magnet body and the RH diffusion source are either brought close to, or spaced part from, each other. This process step will be referred to herein as an "RH diffusion process step".

In addition, according to the present invention, since the RH diffusion source and the sintered R-T-B based magnet body can be loaded into the processing chamber so as to be movable relative to each other and be brought close to, or in contact with, each other and can be moved either continuously or discontinuously, the time it would otherwise take to arrange the RH diffusion source and the sintered R-T-B based magnet body at predetermined positions can be saved.

In that temperature range of 500° C. to 850° C., a rare-earth element can certainly diffuse in a sintered R-T-B based magnet but Dy or Tb is not easily vaporized or sublimed. However, when the present inventors carried out a heat treatment while bringing the RH diffusion source into contact with the sintered R-T-B based magnet body (which will be sometimes simply referred to herein as a "sintered magnet body") in the processing chamber, we discovered, to our surprise, that the heavy rare-earth element RH did diffuse inside of the sintered magnet body and did contribute to increasing its coercivity. The diffusion could be produced successfully in such a temperature range probably because the distance between the RH diffusion source and the sintered magnet body decreased sufficiently by bringing them either close to each other or in contact with each other.

Nevertheless, if the RH diffusion source and the sintered magnet body were maintained at a temperature of 500° C. to 850° C. while being fixed at the same position and kept in contact with each other for a long time, then the RH diffusion source would adhere to the surface of the sintered magnet body, which is a problem. Thus, to overcome such a problem, according to the present invention, the sintered magnet body and the RH diffusion source are loaded in advance into a processing chamber so as to be movable relative to each other and be brought close to, or in contact with, each other, and then moved either continuously or discontinuously in the processing chamber, thereby avoiding such adhesion and getting the RH diffusion done as intended. That is to say, by loading the sintered R-T-B based magnet body and the RH diffusion source into the processing chamber and moving them inside the chamber as described above, it is possible to prevent the RH diffusion source and the sintered magnet body from being fixed at the same position and kept in contact or close to each other for a long time. As a result, the RH diffusion process can be carried out while changing the point of contact between the RH diffusion source and the sintered magnet body either continuously or discontinuously or bringing the RH diffusion source and the sintered magnet body either close to, or spaced apart from, each other.

According to the present invention, as the temperature is maintained in such a low range of 500° C. to 850° C., the RH supply source and the sintered magnet body are kept close to, or in contact with, each other but the RH diffusion source does not melt. That is why even if the RH diffusion process is carried out at such a temperature of 500° C. to 850° C., the heavy rare-earth element RH (which is at least one of Dy and Tb) will not be supplied excessively onto the surface of the sintered R-T-B based magnet. As a result, sufficiently high coercivity can be obtained with a decrease in remanence minimized after the RH diffusion process.

As for a method for moving the sintered R-T-B based magnet body and the RH diffusion source in the processing chamber either continuously or discontinuously during the RH diffusion process, as long as the RH diffusion source and the sintered R-T-B based magnet body can have their relative positions changed without making the sintered R-T-B based magnet body chip or fracture, the processing chamber may be rotated, rocked or subjected to externally applied vibrations as described above, stirring means may be provided in the processing chamber, or any of various other methods may be used as well.

They say that if the magnetocrystalline anisotropy of a sintered R-T-B based magnet is increased on the outer periphery of its main phase crystal grains, the coercivity $H_{cJ}$ of the entire main phase increases effectively. According to the present invention, a heavy rare-earth element replaced layer can be formed on the outer periphery of the main phase not just in a region close to the surface of the sintered R-T-B based magnet body but also in a region deep under the surface of the sintered R-T-B based magnet body. That is why by forming such a layer including the heavy rare-earth element RH in an increased concentration efficiently on the outer periphery of the main phase over the entire sintered magnet body, not just the coercivity $H_{cJ}$ can be increased but also the remanence $B_r$ hardly decreases because a portion, of which the heavy rare-earth element RH concentration does not change before and after the RH diffusion process, remains inside the main phase.

Since only a little heavy rare-earth element RH is introduced, there is not an excessive grain boundary layer component (most of which is rare-earth elements) and such a component will not emerge out of the sintered R-T-B based magnet body and form a thin film of the rare-earth elements on the surface of the sintered magnet body, either.

Also, even if such emergence has occurred temporarily, the rare-earth element that has emerged through inter-diffusion will be introduced into the RH diffusion source and will not left on the surface of the sintered R-T-B based magnet.

Furthermore, according to the present invention, the composition of the sintered R-T-B based magnet body does not have to include any heavy rare-earth element RH. That is to say, a known sintered magnet body, including a light rare-earth element RL (which is at least one of Nd and Pr) as a rare-earth element R, is provided and a heavy rare-earth element RH is diffused inside of the magnet from its surface. According to the present invention, by producing a grain boundary diffusion of the heavy rare-earth element RH, the heavy rare-earth element RH can also be supplied efficiently to the outer periphery of the main phase that is located deep inside of the sintered R-T-B based magnet body. The present invention is naturally applicable to a sintered R-T-B based magnet body to which the heavy rare-earth element RH has already been added. However, if a lot of heavy rare-earth element RH were added, the effects of the present invention would not be achieved sufficiently. That is why a relatively small amount of the heavy rare-earth element RH may be added in that case.

Sintered R-T-B Based Magnet Body

First of all, in a preferred embodiment of the present invention, a sintered R-T-B based magnet body in which the heavy rare-earth element RH needs to diffuse is provided. This sintered R-T-B based magnet body has a composition including:

12 to 17 at % of a rare-earth element R;

5 to 8 at % of B (a portion of which may be replaced with C);

0 to 2 at % of an additive element M (which is at least one element selected from the group consisting of Al, Ti, V, Cr, Mn, Ni, Cu, Zn, Ga, Zr, Nb, Mo, Ag, In, Sn, Hf, Ta, W, Pb and Bi); and T (which is a transition metal consisting mostly of Fe but which may include Co) and inevitable impurities as the balance.

In this case, most of the rare-earth element R is at least one element that is selected from the light rare-earth elements RL (Nd, Pr) but that may include a heavy rare-earth element as well. The heavy rare-earth element, if any, suitably includes at least one of Dy and Tb.

A sintered R-T-B based magnet body with such a composition may be produced by a known manufacturing process.

Hereinafter, a diffusion process step to be performed on the sintered R-T-B based magnet body obtained will be described in detail.

RH Diffusion Source

The RH diffusion source may be either a heavy rare-earth element RH, which is at least one of Dy and Tb, or an alloy thereof, and may have any arbitrary shape (e.g., in the form of a ball, a wire, a plate, a block or powder). If the RH diffusion source has a ball shape or a wire shape, its diameter may be set to be a few millimeters to several centimeters. But if the RH diffusion source has a powder shape, its particle size may fall within the range of 0.05 mm to 5 mm. In this manner, the shape and size of the RH diffusion source are not particularly limited.

Unless the effects of the present invention are lessened, the RH diffusion source may include not only Dy and/or Tb but also at least one element selected from the group consisting of Nd, Pr, La, Ce, Zn, Zr, Sn, Fe and Co.

In addition, the RH diffusion source may further include, as inevitable impurities, at least one element selected from the group consisting of Al, Ti, V, Cr, Mn, Ni, Cu, Ga, Nb, Mo, Ag, In, Hf, Ta, W, Pb, Si and Bi.

Stirring Aid Member

In an embodiment of the present invention, it is recommended that a stirring aid member, as well as the sintered R-T-B based magnet body and the RH diffusion source, be introduced into the processing chamber. The stirring aid member plays the roles of promoting the contact between the RH diffusion source and the sintered R-T-B based magnet body and indirectly supplying the heavy rare-earth element RH that has been once deposited on the stirring aid member itself to the sintered R-T-B based magnet body.

Added to that, the stirring aid member also prevents chipping due to a collision between the sintered R-T-B based magnet bodies or between the sintered R-T-B based magnet body and the RH diffusion source in the processing chamber.

The stirring aid member suitably has a shape that makes it easily movable in the processing chamber. And it is effective to rotate, rock or shake the processing chamber by combining that stirring aid member with the sintered R-T-B based magnet body and the RH diffusion source. Such a shape that makes the stirring aid member easily movable may be a sphere, an ellipsoid, or a circular cylinder with a diameter of several hundred μm to several ten mm.

The stirring aid member is suitably made of a material that does not react easily with the rare-earth magnet, and may also be made of an element belonging to the group including Mo, W, Nb, Ta, Hf and Zr or a mixture thereof.

It is recommended that the stirring aid member be made of a material that has almost the same specific gravity as the sintered R-T-B based magnet body and that does not react easily with the sintered R-T-B based magnet body or the RH diffusion source even if the member contacts with the sintered R-T-B based magnet body or the RH diffusion source during the RH diffusion process. The stirring aid member is suitably made of zirconia, silicon nitride, silicon carbide, boron nitride or a ceramic that includes any combination of these compounds.

RH Diffusion Process

Hereinafter, a typical example of a diffusion process step to produce a magnet according to the present invention will be described with reference to FIG. 1.

In the example illustrated in FIG. 1, sintered R-T-B based magnet bodies 1 and RH diffusion sources 2 have been loaded into a cylinder 3 of stainless steel. Although not shown in FIG. 1, it is recommended that zirconia balls, for example, be introduced as stirring aid members into the cylinder 3. In this example, the cylinder 3 functions as the "processing chamber". The cylinder 3 does not have to be made of stainless steel but may also be made of any other arbitrary material as long as the material has thermal resistance that is high enough to withstand a temperature of 1000° C. or more and hardly reacts with the sintered R-T-B based magnet bodies 1 or the RH diffusion sources 2. For example, the cylinder 3 may also be made of Nb, Mo, W or an alloy including at least one of these elements. The cylinder 3 has a cap 5 that can be opened and closed or removed. Optionally, projections may be arranged on the inner wall of the cylinder 3 so that the RH diffusion sources and the sintered magnet bodies can move and contact with each other efficiently. A cross-sectional shape of the cylinder 3 as viewed perpendicularly to its longitudinal direction does not have to be circular but may also be elliptical, polygonal or any other arbitrary shape. In the example illustrated in FIG. 1, the cylinder 3 is connected to an exhaust system 6. The exhaust system 6 can lower the pressure inside of the cylinder 3. An inert gas such as Ar may be introduced from a gas cylinder (not shown) into the cylinder 3.

The cylinder 3 is heated by a heater 4 which is arranged around the outer periphery of the cylinder 3. When the cylinder 3 is heated, the sintered R-T-B based magnet bodies 1 and the RH diffusion sources 2 that are housed inside the cylinder 3 are also heated. The cylinder 3 is supported rotatably on its center axis and can also be rotated by a motor 7 even while being heated by the heater 4. The rotational velocity of the cylinder 3, which is represented by a surface velocity at the inner wall of the cylinder 3, may be set to be 0.005 m per second or more. The rotational velocity of the cylinder 3 is suitably set to be 0.5 m per second or less so as to prevent the sintered R-T-B based magnet bodies in the cylinder from colliding against each other violently and chipping due to the rotation.

In the example illustrated in FIG. 1, the cylinder is supposed to be rotating. However, according to the present invention, as long as the sintered R-T-B based magnet bodies 1 and the RH diffusion sources 2 are movable relative to each other and can contact with each other in the cylinder 3 during the RH diffusion process, the cylinder 3 does not always have to be rotated but may also be rocked or shaken. Or the cylinder 3 may even be rotated, rocked and/or shaken in combination.

Next, it will be described how to carry out an RH diffusion process using the processing apparatus shown in FIG. 1.

First of all, the cap 5 is removed from the cylinder 3, thereby opening the cylinder 3. And after multiple sintered R-T-B based magnet bodies 1 and RH diffusion sources 2 have been loaded into the cylinder 3, the cap 5 is attached to the cylinder 3 again. Then the inner space of the cylinder 3 is evacuated with the exhaust system 6 connected. When the internal pressure of the cylinder 3 becomes sufficiently low, the exhaust system 6 is disconnected. After heating, an inert gas is introduced until the pressure reaches the required level, and the cylinder 3 is heated by the heater 4 while being rotated by the motor 7.

During the diffusion heat treatment, an inert ambient is suitably maintained in the cylinder 3. In this description, the "inert ambient" refers herein to a vacuum or an inert gas. Also, the "inert gas" may be a rare gas such as argon (Ar) gas but may also be any other gas as long as the gas is not chemically reactive between the sintered magnet bodies 1 and the RH diffusion sources 2. The pressure of the inert gas is suitably equal to, or lower than, the atmospheric pressure. If the pressure of the ambient gas inside the cylinder 3 were close to the atmospheric pressure, then the heavy rare-earth element RH would not be supplied easily from the RH diffusion sources 2 onto the surface of the sintered magnet bodies 1 according to the technique disclosed in Patent Document No. 1, for example. However, since the RH diffusion sources 2 and the sintered R-T-B based magnet bodies 1 are arranged either close to, or in contact with, each other, according to this embodiment, the RH diffusion process can be carried out at a higher pressure than in Patent Document No. 1. Also, there is relatively weak correlation between the degree of vacuum and the amount of RH supplied. Thus, even if the degree of vacuum were further increased, the amount of the heavy rare-earth element RH supplied (and eventually the degree of increase in coercivity) would not change significantly. The amount supplied is more sensitive to the temperature of the sintered R-T-B based magnet bodies than the pressure of the ambient.

In this embodiment, the RH diffusion sources 2 including the heavy rare-earth element RH and the sintered R-T-B based magnet bodies 1 are heated while being moved relative to each other, thereby supplying the heavy rare-earth element RH from the RH diffusion sources 2 onto the surface of the sintered R-T-B based magnet bodies 1 and diffusing the heavy rare-earth element RH inside of the sintered magnet bodies at the same time.

During the diffusion process, the surface velocity at the inner wall of the processing chamber may be set to be 0.005 m/s or more, for example. If the rotational velocity were too low, the point of contact between the sintered R-T-B based magnet bodies and the RH diffusion sources would shift so slowly as to cause adhesion between them easily. That is why the higher the diffusion temperature, the higher the rotational velocity of the processing chamber should be. A suitable rotational velocity varies according to not just the diffusion temperature but also the shape and size of the RH diffusion source as well.

In this embodiment, the temperature of the RH diffusion sources 2 and the sintered R-T-B based magnet bodies is suitably maintained within the range of 500° C. to 1000° C. This is a proper temperature range for the heavy rare-earth element RH to diffuse inward in the internal structure of the sintered R-T-B based magnet bodies 1 through the grain boundary phase.

The amount of time for maintaining that temperature is determined by the ratio of the total volume of the sintered R-T-B based magnet bodies 1 loaded to that of the RH diffusion sources 2 loaded during the RH diffusion process step, the shape of the sintered R-T-B based magnet bodies 1, the shape of the RH diffusion sources 2, the rate of diffusion of the heavy rare-earth element RH into the sintered R-T-B based magnet bodies 1 through the RH diffusion process (which will be referred to herein as a "diffusion rate") and other factors.

The pressure of the ambient gas during the RH diffusion process (i.e., the pressure of the ambient inside the processing chamber) may be set to fall within the range of $10^{-3}$ Pa through the atmospheric pressure, for example.

First Heat Treatment Process

Optionally, after the RH diffusion process, the sintered R-T-B based magnet bodies 1 may be subjected to a first heat treatment process in order to distribute more uniformly the heavy rare-earth element RH diffused. In that case, after the RH diffusion sources have been removed, the first heat treatment process is carried out within the temperature range of 700° C. to 1000° C. in which the heavy rare-earth element RH can diffuse substantially, more suitably within the range of 850° C. to 950° C. In this first heat treatment process, no heavy rare-earth element RH is further supplied onto the sintered R-T-B based magnet bodies 1 but the heavy rare-earth element RH does diffuse inside of the sintered R-T-B based magnet bodies 1. As a result, the heavy rare-earth element RH diffusing can reach deep inside under the surface of the sintered magnets, and the magnets as a whole can eventually have increased coercivity. The first heat treatment process may be carried out for a period of time of 10 minutes to 72 hours, for example, and suitably for 1 to 12 hours. In this case, the pressure of the ambient in the heat treatment furnace where the first heat treatment process is carried out is equal to, or lower than, the atmospheric pressure and is suitably 100 kPa or less.

Second Heat Treatment Process

Also, if necessary, a second heat treatment process may be further carried out at a temperature of 400° C. to 700 AD. However, if the first heat treatment process (at 700° C. to 1000° C.) and the second heat treatment process (at 400° C. to 700° C.) are both conducted, it is recommended that the second heat treatment process be carried out after the first heat treatment process (at 700° C. to 1000° C.). The first heat treatment process (at 700° C. to 1000° C.) and the second heat treatment process (at 400° C. to 700° C.) may be performed in the same processing chamber. The second heat treatment process may be performed for a period of time of 10 minutes to 72 hours, and suitably performed for 1 to 12 hours. In this case, the pressure of the ambient in the heat treatment furnace where the second heat treatment process is carried out is equal to, or lower than, the atmospheric pressure and is suitably 100 kPa or less. Optionally, only the second heat treatment process may be carried out with the first heat treatment process omitted.

EXPERIMENTAL EXAMPLE 1

(Sample #1)

First, thin alloy flakes with thicknesses of 0.2 mm to 0.3 mm were made by performing a strip casting process using an alloy that had been prepared so as to have a composition including 30.5 mass % of Nd, 1.0 mass % of B, 0.9 mass % of Co, 0.1 mass % of Cu, 0.2 mass % of Al and Fe as the balance.

Next, a vessel was loaded with those thin alloy flakes and then introduced into a hydrogen pulverizer, which was filled with a hydrogen gas ambient at a pressure of 500 kPa. In this manner, hydrogen was absorbed into the thin alloy flakes at room temperature and then desorbed. By performing such a hydrogen process, the thin alloy flakes were embrittled to obtain a powder in indefinite shapes with sizes of about 0.15 mm to about 0.2 mm.

Thereafter, 0.05 mass % of zinc stearate was added as pulverization aid to the coarsely pulverized powder obtained by the hydrogen process and then the mixture was pulverized with a jet mill to obtain a fine powder with a particle size of approximately 3 μm.

The fine powder thus obtained was compacted with a press machine to make a powder compact. More specifically, the powder particles were pressed and compacted while being aligned with a magnetic field applied. Thereafter, the powder compact was unloaded from the press machine and then subjected to a sintering process at 1020° C. for four hours in a vacuum furnace.

Sintered blocks were made in this manner and then machined to obtain sintered R-T-B based magnet bodies having a thickness of 7 mm, a length of 10 mm and a width of 10 mm.

Next, an RH diffusion process was carried out using the heat treatment system shown in FIG. 1. Specifically, 50 g of sintered magnets, 50 g of RH diffusion sources (spheres of 99.9 mass % of Dy with a diameter of 3 mm or less), and 50 g of stirring aid members (spheres of zirconia with a diameter of 5 mm) were introduced sequentially into the vessel, in which an argon gas ambient with a pressure of 100 Pa was created and the temperature was set to be 820° C. Also, by rotating the vessel at a surface velocity of 0.02 m/s on its center axis, the contents of the vessel were stirred up and moved either continuously or discontinuously so as to be movable relative to each other or brought close to, or in contact with, each other, while being subjected to a heat treatment for six hours. In this manner, an RH diffusion process was carried out to introduce Dy into the sintered R-T-B based magnets by diffusion. In the RH diffusion process, the heat treatment environment was created in the following manner. Specifically, after those contents had been housed into the vessel, the inside of the vessel was evacuated. The temperature was raised to 600° C. at a rate of 10° C. per minute in the vacuum, and then an argon gas was introduced so that the pressure in the vessel would be 100 Pa. After that, the vessel started to be rotated and the temperature in the vessel was raised to 820° C. at a rate of 10° C. per minute. After the heat treatment was over, it was not until the inner space in the vessel was cooled naturally to room temperature that the contents were unloaded and the sintered magnets were separated from the RH diffusion introducing members and the stirring aid members. Thereafter, the sintered magnets were loaded into another heat treatment furnace, where the magnets were subjected to a first heat treatment at 860° C. for six hours with the pressure in the furnace set to be 100 Pa and then subjected to a second heat treatment at 500° C. for three hours.

(Sample #2)

First, thin alloy flakes with thicknesses of 0.2 mm to 0.3 mm were made by performing a strip casting process using an alloy that had been prepared so as to have a composition including 30.5 mass % of Nd, 1.0 mass % of B, 0.9 mass % of Co, 0.1 mass % of Cu, 0.2 mass % of Al and Fe as the balance.

Next, a vessel was loaded with those thin alloy flakes and then introduced into a hydrogen pulverizer, which was filled with a hydrogen gas ambient at a pressure of 500 kPa. In this manner, hydrogen was absorbed into the thin alloy flakes at room temperature and then desorbed. By performing such a hydrogen process, the thin alloy flakes were embrittled to obtain a powder in indefinite shapes with sizes of about 0.15 mm to about 0.2 mm.

Thereafter, 0.05 mass % of zinc stearate was added as pulverization aid to the coarsely pulverized powder obtained by the hydrogen process and then the mixture was pulverized with a jet mill to obtain a fine powder with a particle size of approximately 3 μm.

The fine powder thus obtained was compacted with a press machine to make a powder compact. More specifically, the powder particles were pressed and compacted while being aligned with a magnetic field applied. Thereafter, the powder compact was unloaded from the press machine and then subjected to a sintering process at 1020° C. for four hours in a vacuum furnace. Sintered blocks were made in this manner and then machined to obtain sintered R-T-B based magnet bodies having a thickness of 7 mm, a length of 10 mm and a width of 10 mm.

These sintered magnet bodies were subjected to an RH diffusion process by the method disclosed in Patent Document No. 1. Specifically, the sintered magnet bodies were loaded into a process vessel having the configuration shown in FIG. 1 of Patent Document No. 1. The process vessel used in this comparative example was made of Mo and included a member for supporting a plurality of sintered magnet bodies and a member for holding two RH diffusion sources. The interval between the sintered magnet bodies and the RH diffusion sources was set to be 5 mm. The RH diffusion sources were made of Dy with a purity of 99.9% and had a size of 30 mm×30 mm×5 mm.

Next, a first heat treatment process was carried out by heating the process vessel shown in FIG. 1 of Patent Document No. 1 in a vacuum heat treatment furnace. This heat treatment process was conducted at 900° C. for two hours at an ambient pressure of $1.0\times10^{-2}$ Pa. After the first heat treatment process was finished, a second heat treatment process was carried out at 500° C. for one hour at a pressure of 2 Pa.

(Sample #3)

First, thin alloy flakes with thicknesses of 0.2 mm to 0.3 mm were made by performing a strip casting process using an alloy that had been prepared so as to have a composition including 30.5 mass % of Nd, 1.0 mass % of B, 0.9 mass % of Co, 0.1 mass % of Cu, 0.2 mass % of Al and Fe as the balance.

Next, a vessel was loaded with those thin alloy flakes and then introduced into a hydrogen pulverizer, which was filled with a hydrogen gas ambient at a pressure of 500 kPa. In this manner, hydrogen was absorbed into the thin alloy flakes at room temperature and then desorbed. By performing such a hydrogen process, the thin alloy flakes were embrittled to obtain a powder in indefinite shapes with sizes of about 0.15 mm to about 0.2 mm.

Thereafter, 0.05 mass % of zinc stearate was added as pulverization aid to the coarsely pulverized powder obtained by the hydrogen process and then the mixture was pulverized with a jet mill to obtain a fine powder with a particle size of approximately 3 μm.

The fine powder thus obtained was compacted with a press machine to make a powder compact. More specifically, the powder particles were pressed and compacted while being aligned with a magnetic field applied. Thereafter, the powder compact was unloaded from the press machine and then subjected to a sintering process at 1020° C. for four hours in a vacuum furnace. Sintered blocks were made in this manner and then machined to obtain sintered R-T-B based magnet bodies having a thickness of 7 mm, a length of 10 mm and a width of 10 mm.

Those Samples #1 through #3 of sintered magnets that had been obtained through such process steps had their cross section observed and their magnetic properties compared to each other in the following respects.

Cross-Sectional Observation

Figure 2:
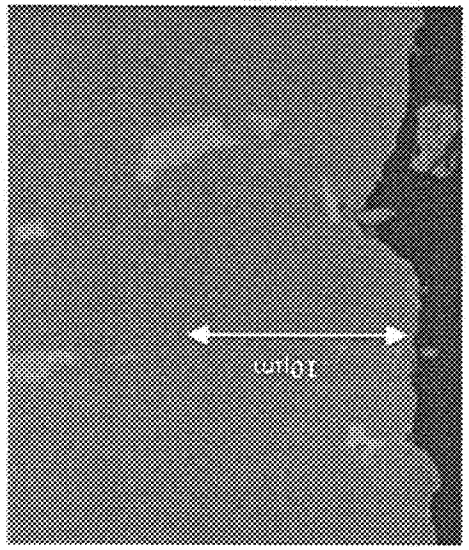
FIG. 2 A BEI (backscattered electron image) showing a cross section of a specific example of the present invention.
Figure 3:
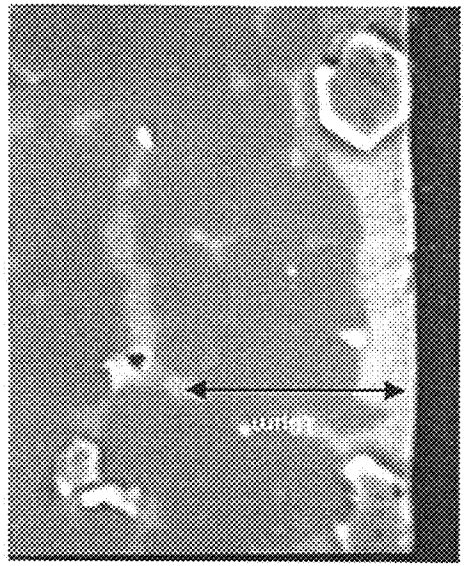
FIG. 3 A BEI (backscattered electron image) showing a cross section of a comparative example.

Samples #1 and #2 were analyzed with an EPMA (produced by Shimadzu Corporation) to see how Dy, Nd and Fe diffused inside them. FIG. 2 is a BEI (backscattered electron image) showing a cross section of Sample #1 as a specific example of the present invention. On the other hand, FIG. 3 is a BEI (backscattered electron image) showing a cross section of Sample #2 as a comparative example. As can be seen clearly from the cross-sectional BEI (backscattered electron image) shown in FIG. 3, Sample #2 had a layer with a thickness of approximately 10 μm (i.e., a layer with high lightness in a surface region of the magnet in the image shown in FIG. 3) in the surface region of the sintered R-T-B based magnet. The results of evaluation with the EPMA revealed that that layer included Dy and Nd and was a layer including rare-earth elements at a high concentration. As for Sample #1, on the other hand, no such layer including rare-earth elements at a high concentration was detected in the surface region of the sintered R-T-B based magnet as can be seen easily from FIG. 2.

Magnetic Properties

Samples #1, #2 and #3 were subjected to a pulse magnetization at 3 MA/m and then had their magnetic properties (specifically, their remanence $B_r$ and coercivity $H_{cJ}$) measured with a B-H tracer. The results are shown in the following Table 1. In this case, the sintered magnets produced had had their surface region removed to a depth of 10 μm by shot blasting in order to eliminate impurities from their surface region.

TABLE 1

| | Remanence | | Coercivity | |
|---|---|---|---|---|
| Sample | $B_r$ (T) | $\Delta B_r$ (T) (difference from Sample #3) | $H_{cJ}$ (kA/m) | $\Delta H_{cJ}$ (kA/m) (difference from Sample #3) |
| 1 | 1.39 | 0 | 1220 | 370 |
| 2 | 1.39 | 0 | 1215 | 365 |
| 3 | 1.39 | — | 850 | — |

As can be seen from the results shown in this Table 1, it was confirmed that the coercivity increased, but the remanence did not decrease, in both of Samples #1 and #2 compared to Sample #3.

Considering these results of the cross-sectional observation and magnetic properties evaluation, in Sample #1 representing a specific example of the present invention, the smaller amount of heavy rare-earth element RH would have been diffused efficiently in the sintered R-T-B based magnet and therefore should have formed almost no thin film of the heavy rare-earth element in the surface region of the sintered R-T-B based rare-earth magnet unlike Sample #2 representing a comparative example.

In addition, since Sample #1 was subjected to the diffusion process step at 820 AD, only a little heavy rare-earth element RH would have vaporized from the RH diffusion source, including the heavy rare-earth element RH, and been introduced into the surface region of the sintered R-T-B based magnet.

Furthermore, as for Sample #1, since the RH diffusion sources and the sintered R-T-B based magnets were repeatedly brought into contact with, and separated from, each other in the heat treatment furnace at 820° C., the RH diffusion sources and the sintered R-T-B based magnets could be brought into direct contact with each other without causing adhesion and the heavy rare-earth element RH diffused efficiency from the RH diffusion sources into the sintered R-T-B based magnets. That is why there was no significant difference in their improved magnetic properties between the individual magnets obtained.

EXPERIMENTAL EXAMPLE 2

(Sample #4)

Sintered R-T-B based magnets were obtained under the same condition as Sample #1 except that the alloy used had been prepared so as to have a composition including 19.8 mass % of Nd, 5.6 mass % of Pr, 4.3 mass % of Dy, 0.93 mass % of B, 2.0 mass % of Co, 0.1 mass % of Cu, 0.14 mass % of Al, 0.08 mass % of Ga, and Fe as the balance.

(Sample #5)

Sintered R-T-B based magnets were obtained under the same condition as Sample #2 except that the alloy used had been prepared so as to have a composition including 19.8 mass % of Nd, 5.6 mass % of Pr, 4.3 mass % of Dy, 0.93 mass % of B, 2.0 mass % of Co, 0.1 mass % of Cu, 0.14 mass % of Al, 0.08 mass % of Ga, and Fe as the balance.

(Sample #6)

Sintered R-T-B based magnets were obtained under the same condition as Sample #3 except that the alloy used had been prepared so as to have a composition including 19.8 mass % of Nd, 5.6 mass % of Pr, 4.3 mass % of Dy, 0.93 mass % of B, 2.0 mass % of Co, 0.1 mass % of Cu, 0.14 mass % of Al, 0.08 mass % of Ga, and Fe as the balance.

(Sample #7)

Sintered R-T-B based magnets were obtained under the same condition as Sample #1 except that the alloy used had been prepared so as to have a composition including 30.0 mass % of Nd, 0.5 mass % of Dy, 1.0 mass % of B, 0.9 mass % of Co, 0.1 mass % of Cu, 0.1 mass % of Al and Fe as the balance.

(Sample #8)

Sintered R-T-B based magnets were obtained under the same condition as Sample #2 except that the alloy used had been prepared so as to have a composition including 30.0 mass % of Nd, 0.5 mass % of Dy, 1.0 mass % of B, 0.9 mass % of Co, 0.1 mass % of Cu, 0.1 mass % of Al and Fe as the balance.

(Sample #9)

Sintered R-T-B based magnets were obtained under the same condition as Sample #3 except that the alloy used had been prepared so as to have a composition including 30.0 mass % of Nd, 0.5 mass % of Dy, 1.0 mass % of B, 0.9 mass % of Co, 0.1 mass % of Cu, 0.1 mass % of Al and Fe as the balance.

ICP analysis

Each of the sintered R-T-B based rare-earth magnets had its amount of TRE (A) measured in its portion that reached a depth of 500 μm from its surface region toward its core portion and also had its amount of TRE (B) measured in its core portion. The results of the measurements are summarized in the following Table 2.

Specifically, the amount of TRE (A) of that surface-to-core 500 μm portion of the sintered R-T-B based rare-earth magnet was estimated by ICP with that surface-to-core 500 μm portion cut out after the sintered magnet had gone through the RH diffusion process and the first and second heat treatment processes.

On the other hand, the amount of TRE (B) of the core portion of the sintered R-T-B based rare-earth magnet was estimated by ICP with the core portion (with a volume of 50 $mm^3$) of the sintered magnet cut out after the magnet had gone through the diffusion process. More specifically, the core portion is a portion of the sintered R-T-B based rare-earth magnet to be cut out of its core so as to have a volume of 50 $mm^3$ and an analogous shape to that of the sintered R-T-B based rare-earth magnet itself.

TABLE 2

| Sample | Difference (A − B) in amount of TRE between surface-to-core 500 μm portion and core portion | Amount of TRE: surface-to-core 500 μm portion A (mass %) | Amount of TRE: Core portion B (mass %) |
|---|---|---|---|
| 1 | 0.6 | 31.1 | 30.5 |
| 2 | 1.6 | 32.1 | 30.5 |
| 4 | 0.8 | 30.5 | 29.7 |
| 5 | 1.9 | 31.6 | 29.7 |
| 7 | 0.7 | 31.2 | 30.5 |
| 8 | 1.7 | 32.2 | 30.5 |

In Sample #1 of Experimental Example 1, that surface-to-core 500 μm portion of the sintered R-T-B based rare-earth magnet had an amount of TRE of 31.1 mass %, its core portion had an amount of TRE of 30.5 mass %, and the difference in the amount of TRE between the surface-to-core 500 μm portion of the sintered R-T-B based rare-earth magnet and the core portion was 0.6.

In Sample #2 of Experimental Example 1, on the other hand, that surface-to-core 500 μm portion of the sintered R-T-B based rare-earth magnet had an amount of TRE of 32.1 mass %, its core portion had an amount of TRE of 30.5 mass %, and the difference in the amount of TRE between the surface-to-core 500 μm portion of the sintered R-T-B based rare-earth magnet and the core portion was 1.6.

In Sample #4, that surface-to-core 500 μm portion of the sintered R-T-B based rare-earth magnet had an amount of TRE of 30.5 mass %, its core portion had an amount of TRE of 29.7 mass %, and the difference in the amount of TRE between the surface-to-core 500 μm portion of the sintered R-T-B based rare-earth magnet and the core portion was 0.8.

In Sample #5, that surface-to-core 500 μm portion of the sintered R-T-B based rare-earth magnet had an amount of TRE of 31.6 mass %, its core portion had an amount of TRE of 29.7 mass %, and the difference in the amount of TRE between the surface-to-core 500 μm portion of the sintered R-T-B based rare-earth magnet and the core portion was 1.9.

In Sample #7, that surface-to-core 500 μm portion of the sintered R-T-B based rare-earth magnet had an amount of TRE of 31.2 mass %, its core portion had an amount of TRE of 30.5 mass %, and the difference in the amount of TRE between the surface-to-core 500 μm portion of the sintered R-T-B based rare-earth magnet and the core portion was 0.7.

In Sample #8, that surface-to-core 500 μm portion of the sintered R-T-B based rare-earth magnet had an amount of TRE of 32.2 mass %, its core portion had an amount of TRE of 30.5 mass %, and the difference in the amount of TRE between the surface-to-core 500 μm portion of the sintered R-T-B based rare-earth magnet and the core portion was 1.7.

As can be seen from Table 2, in each of Samples #1, #4 and #7 representing specific examples of the present invention, the difference in the amount of TRE between that surface-to-core 500 μm portion of the sintered R-T-B based rare-earth magnet and its core portion was 1.0 or less.

On the other hand, in each of Samples #2, #5 and #8 representing comparative examples, the difference in the amount of TRE between that surface-to-core 500 μm portion of the sintered R-T-B based rare-earth magnet and its core portion was more than 1.0.

Corrosion Resistance

A PCT test was carried out (at 125° C.×85% RH-0.2 MPa) to compare the corrosion resistance. The sintered magnets that were used in the PCT test had had their surface layer removed by shot-blasting to a depth of 10 μm as measured from their surface. The results are shown in the following Table 3:

TABLE 3

| | Rate of decrease in mass ($g/m^2$) | | | |
|---|---|---|---|---|
| Sample | 25 hrs | 50 hrs | 75 hrs | 100 hrs |
| 1 | 0.3 | 0.4 | 0.5 | 0.7 |
| 2 | 0.8 | 1.3 | 1.6 | 2.0 |
| 4 | 0.1 | 0.2 | 0.3 | 0.5 |
| 5 | 0.6 | 1.0 | 1.3 | 1.8 |
| 7 | 0.1 | 0.3 | 0.3 | 0.5 |
| 8 | 0.6 | 1.0 | 1.4 | 1.8 |

Sample #1 had no high-concentration layer in the first place, and therefore, its rate of decrease in mass was 0.5 $g/m^2$ or less in any of 25, 50 and 75 hours and was 0.7 $g/m^2$ in 100 hours, which was almost as high as that of Sample #3. On the other hand, Sample #2 still had a high-concentration layer even after having its surface layer removed to a depth of 10 μm, and therefore, its rates of decrease in mass were 0.8 $g/m^2$, 1.3 $g/m^2$ and 2.0 $g/m^2$ in 25, 50 and 100 hours, respectively, which were far higher than those of Sample #3.

Sample #4 had no high-concentration layer in the first place, and therefore, its rate of decrease in mass was 0.3 $g/m^2$ or less in any of 25, 50 and 75 hours and was 0.5 $g/m^2$ in 100 hours, which was almost as high as that of Sample #6. On the other hand, Sample #5 still had a high-concentration layer even after having its surface layer removed to a depth of 10 μm, and therefore, its rates of decrease in mass were 0.6 $g/m^2$, 1.0 $g/m^2$ and 1.8 $g/m^2$ in 25, 50 and 100 hours, respectively, which were far higher than those of Sample #6. In Sample #5, its rates of decrease in mass increased probably because the sample could be oxidized easily due to the presence of the rare-earth high-concentration layer on the surface of the sintered R-T-B based magnet.

Sample #7 had no high-concentration layer in the first place, and therefore, its rate of decrease in mass was 0.3 $g/m^2$ or less in any of 25, 50 and 75 hours and was 0.5 $g/m^2$ in 100 hours, which was almost as high as that of Sample #9.

On the other hand, Sample #8 still had a high-concentration layer even after having its surface layer removed to a depth of 10 μm, and therefore, its rates of decrease in mass were 0.6 $g/m^2$, 1.0 $g/m^2$ and 1.8 $g/m^2$ in 25, 50 and 100 hours, respectively, which were far higher than those of Sample #9. In Sample #8, its rates of decrease in mass increased probably because the sample could be oxidized easily due to the presence of the rare-earth high-concentration layer on the surface of the sintered R-T-B based magnet.

EXPERIMENTAL EXAMPLE 3

(Sample #10)

Sintered R-T-B based magnets were obtained by performing an RH diffusion process under the same condition as Sample #1 except that the alloy used had been prepared so as to have a composition including 30.5 mass % of Nd, 0.1 mass % of Pr, 1.0 mass % of B, 0.9 mass % of Co, 0.1 mass % of Cu, 0.2 mass % of Al, 0.1 mass % of Ga, and Fe as the balance and that spheres of 99.9 mass % Tb with a diameter of 3 mm or less were used as the RH diffusion sources.

(Sample #11)

Sintered R-T-B based magnets were obtained under the same condition as Sample #3 except that the alloy used had been prepared so as to have a composition including 30.5 mass % of Nd, 0.1 mass % of Pr, 1.0 mass % of B, 0.9 mass % of Co, 0.1 mass % of Cu, 0.2 mass % of Al, 0.1 mass % of Ga, and Fe as the balance.

Magnetic Properties

Samples #10 and #11 were subjected to a pulse magnetization at 3 MA/m and then had their magnetic properties (specifically, their remanence $B_r$ and coercivity $H_{CJ}$) measured with a B-H tracer. The results are shown in the following Table 4. In this case, the sintered magnets produced had had their surface region removed to a depth of 10 pm by shot blasting in order to eliminate impurities from their surface region.

TABLE 4

| | Remanence | | Coercivity | |
|---|---|---|---|---|
| Sample | $B_r$ (T) | $\Delta B_r$ (T) (difference from Sample #11) | $H_{cJ}$ (kA/m) | $\Delta H_{cJ}$ (kA/m) (difference from Sample #11) |
| 10 | 1.39 | 0 | 1450 | 500 |
| 11 | 1.39 | — | 950 | — |

As can be seen from the results shown in this Table 4, it was confirmed that the coercivity increased, but the remanence did not decrease, in Sample #10 compared to Sample #11.

Considering these results of the cross-sectional observation and magnetic properties evaluation, in Sample #10 representing a specific example of the present invention, the smaller amount of heavy rare-earth element RH would have been diffused efficiently in the sintered R-T-B based magnet and therefore should have formed almost no thin film of the heavy rare-earth element in the surface region of the sintered R-T-B based rare-earth magnet just like Sample #1 representing a specific example of the present invention.

In addition, since Sample #10 was subjected to the diffusion process step at 820 ° C., only a little heavy rare-earth element RH would have vaporized from the RH diffusion source, including the heavy rare-earth element RH, and been introduced into the surface region of the sintered R-T-B based magnet.

Furthermore, as for Sample #10, since the RH diffusion sources and the sintered R-T-B based magnets were repeatedly brought into contact with, and separated from, each other in the heat treatment furnace at 820° C., the RH diffusion sources and the sintered R-T-B based magnets could be brought into direct contact with each other without causing adhesion and the heavy rare-earth element RH diffused efficiency from the RH diffusion sources into the sintered R-T-B based magnets. That is why there was no significant difference in their improved magnetic properties between the individual magnets obtained.

EXPERIMENTAL EXAMPLE 4

(Sample #12)

Sintered R-T-B based magnets were obtained under the same condition as Sample #10 except that the alloy used had been prepared so as to have a composition including 19.8 mass % of Nd, 5.3 mass % of Pr, 4.4 mass % of Dy, 0.93 mass % of B, 2.0 mass % of Co, 0.1 mass % of Cu, 0.14 mass % of Al, 0.08 mass % of Ga, and Fe as the balance.

(Sample #13)

Sintered R-T-B based magnets were obtained under the same condition as Sample #11 except that the alloy used had been prepared so as to have a composition including 19.8 mass % of Nd, 5.3 mass % of Pr, 4.4 mass % of Dy, 0.93 mass % of B, 2.0 mass % of Co, 0.1 mass % of Cu, 0.14 mass % of Al, 0.08 mass % of Ga, and Fe as the balance.

(Sample #14)

Sintered R-T-B based magnets were obtained under the same condition as Sample #10 except that the alloy used had been prepared so as to have a composition including 30.2 mass % of Nd, 0.6 mass % of Dy, 1.0 mass % of B, 0.9 mass % of Co, 0.1 mass % of Cu, 0.1 mass % of Al, and Fe as the balance.

(Sample #15)

Sintered R-T-B based magnets were obtained under the same condition as Sample #11 except that the alloy used had been prepared so as to have a composition including 30.2 mass % of Nd, 0.6 mass % of Dy, 1.0 mass % of B, 0.9 mass % of Co, 0.1 mass % of Cu, 0.1 mass % of Al, and Fe as the balance.

ICP Analysis

Each of the sintered R-T-B based rare-earth magnets had its amount of TRE (A) measured in its portion that reached a depth of 500 μm from its surface region toward its core portion and also had its amount of TRE (B) measured in its core portion. The results of the measurements are summarized in the following Table 5.

Specifically, the amount of TRE (A) of that surface-to-core 500 μm portion of the sintered R-T-B based rare-earth magnet was estimated by ICP with that surface-to-core 500 μm portion cut out after the magnet had gone through the RH diffusion process and the first and second heat treatment processes.

On the other hand, the amount of TRE (B) of the core portion of the sintered R-T-B based rare-earth magnet was estimated by ICP with the core portion (with a volume of 50 $mm^3$) of the sintered R-T-B based magnet cut out after the magnet had gone through the diffusion process. More specifically, the core portion is a portion of the sintered R-T-B based rare-earth magnet to be cut out of its core so as to have a volume of 50 $mm^3$ and an analogous shape to that of the sintered R-T-B based rare-earth magnet itself.

TABLE 5

| Sample | Difference (A − B) in amount of TRE between surface-to-core 500 μm portion and core portion | Amount of TRE: surface-to-core 500 μm portion A (mass %) | Amount of TRE: Core portion B (mass %) |
|---|---|---|---|
| 10 | 0.5 | 31.1 | 30.6 |
| 12 | 0.9 | 30.4 | 29.5 |
| 14 | 0.7 | 31.5 | 30.8 |

In Sample #10 of Experimental Example 3, that surface-to-core 500 μm portion of the sintered R-T-B based rare-earth magnet had an amount of TRE of 31.1 mass %, its core portion had an amount of TRE of 30.6 mass %, and the difference in the amount of TRE between the surface-to-core 500 μm portion of the sintered R-T-B based rare-earth magnet and the core portion was 0.5.

In Sample #12 of Experimental Example 4, on the other hand, that surface-to-core 500 μm portion of the sintered R-T-B based rare-earth magnet had an amount of TRE of 30.4 mass %, its core portion had an amount of TRE of 29.5 mass %, and the difference in the amount of TRE between the surface-to-core 500 μm portion of the sintered R-T-B based rare-earth magnet and the core portion was 0.9.

In Sample #14 of Experimental Example 4, that surface-to-core 500 μm portion of the sintered R-T-B based rare-earth magnet had an amount of TRE of 31.5 mass %, its core portion had an amount of TRE of 30.8 mass %, and the difference in the amount of TRE between the surface-to-core 500 μm portion of the sintered R-T-B based rare-earth magnet and the core portion was 0.7.

Corrosion Resistance

A PCT test was carried out (at 125° C.×85% RH-0.2 MPa) to compare the corrosion resistance. The sintered magnets that were used in the PCT test had had their surface layer removed by shot-blasting to a depth of 10 μm as measured from their surface. The results are shown in the following Table 6:

TABLE 6

| Sample | Rate of decrease in mass ($g/m^2$): 25 hrs | 50 hrs | 75 hrs | 100 hrs |
|---|---|---|---|---|
| 10 | 0.3 | 0.4 | 0.5 | 0.7 |
| 12 | 0.1 | 0.3 | 0.3 | 0.5 |
| 14 | 0.1 | 0.2 | 0.3 | 0.5 |

Sample #10 had no high-concentration layer in the first place, and therefore, its rate of decrease in mass was 0.5 $g/m^2$ or less in any of 25, 50 and 75 hours and was 0.7 $g/m^2$ in 100 hours, which was almost as high as that of Sample #11. Sample #12 had no high-concentration layer in the first place, and therefore, its rate of decrease in mass was 0.3 $g/m^2$ or less in any of 25, 50 and 75 hours and was 0.5 $g/m^2$ in 100 hours, which was almost as high as that of Sample #13. Sample #14 had no high-concentration layer in the first place, and therefore, its rate of decrease in mass was 0.3 $g/m^2$ or less in any of 25, 50 and 75 hours and was 0.5 $g/m^2$ in 100 hours, which was almost as high as that of Sample #15.

INDUSTRIAL APPLICABILITY

According to the present invention, a sintered R-T-B based magnet can be produced so that its remanence and coercivity are both high. Thus, the sintered magnet of the present invention can be used effectively in various types of motors such as a motor for a hybrid car to be exposed to high temperatures and in numerous kinds of consumer electronic appliances.

REFERENCE SIGNS LIST

1 sintered R-T-B based magnet body
2 RH diffusion source
3 cylinder made of stainless steel (processing chamber)
4 heater
5 cap
6 exhaust system

The invention claimed is:

1. A sintered R-T-B based rare-earth magnet comprising:

$R_2Fe_{14}B$ based compound crystal grains as a main phase, including a light rare-earth element RL, which includes at least one of Nd and Pr, as a major rare-earth element R; and a heavy rare-earth element RH which includes at least one of Dy and Tb, wherein before its surface region is removed, the sintered R-T-B based rare-earth magnet has no alloy layer including a heavy rare-earth element RH that has been introduced from outside of the sintered R-T-B based rare-earth magnet to cause RH diffusion and a light rare-earth element RL that has emerged from inside of the sintered R-T-B based rare-earth magnet as a result of the RH diffusion, and wherein the sintered R-T-B based rare-earth magnet has a portion in which coercivity decreases gradually from its surface region toward its core portion, and wherein the difference in the amount of TRE, which is a total mass percentage of rare-earth elements including the light rare-earth element RL and the heavy rare-earth element RH per unit volume, between a portion of the sintered R-T-B based rare-earth magnet that reaches a depth of 500 μm as measured from its surface region toward its core portion and the core portion of the sintered R-T-B based rare-earth magnet is 0.1 mass % through 1.0 mass %;

wherein the amount of TRE of the sintered R-T-B based rare-earth magnet is 29.5 mass % to 30.8 mass %, and wherein an average concentration of elements other than the rare-earth element R does not change in a depth direction from its surface toward its core portion of the sintered R-T-B based rare-earth magnet.

* * * * *